US006995637B2

(12) United States Patent
Tamura et al.

(10) Patent No.: US 6,995,637 B2
(45) Date of Patent: Feb. 7, 2006

(54) WAVEGUIDE, HIGH-FREQUENCY CIRCUIT, AND HIGH-FREQUENCY CIRCUIT DEVICE

(75) Inventors: Shinichi Tamura, Moriyama (JP); Atsushi Saitoh, Muko (JP); Taiyo Nishiyama, Otsu (JP); Takatoshi Kato, Mino (JP); Hiroaki Tanaka, Osaka-fu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 10/713,222

(22) Filed: Nov. 17, 2003

(65) Prior Publication Data

US 2004/0104793 A1 Jun. 3, 2004

(30) Foreign Application Priority Data

Nov. 29, 2002 (JP) ..... 2002-348095

(51) Int. Cl.
*H01P 3/12* (2006.01)

(52) U.S. Cl. ..... 333/239; 333/248

(58) Field of Classification Search ..... 333/208, 333/212, 239, 248, 249, 252, 254; 29/600
See application file for complete search history.

(56) References Cited

U.S. PATENT DOCUMENTS 4,284,967 A * 8/1981 Yoshimura ..... 333/248
2004/0056739 A1 * 3/2004 Inuzuka et al.- ..... 333/239

FOREIGN PATENT DOCUMENTS

| | | |
|---|---|---|
| CA | 2197909 | 9/1998 |
| CN | 1268586 A | 10/2000 |
| JP | 50-122846 | 9/1975 |
| JP | 2001-308611 | 11/2001 |
| JP | 2002-76716 | 3/2002 |

OTHER PUBLICATIONS

European Search Report dated Mar. 30, 2004.

* cited by examiner

*Primary Examiner*—Seungsook Ham
(74) *Attorney, Agent, or Firm*—Dickstein, Shapiro, Morin & Oshinsky, LLP.

(57) ABSTRACT

A waveguide, a high-frequency circuit, and a high-frequency circuit device having the waveguide are provided. The waveguide includes two conductor plates each of which has a surface having a groove. At least one of the conductor plates has protrusions extending from the surface at both sides of the groove. The two conductor plates are in contact with each other such that the grooves face each other. Screws disposed between the protrusions and bumps, which are formed outside the protrusions on the conductor plate, fasten the conductor plates with a predetermined pressure.

20 Claims, 6 Drawing Sheets

WAVEGUIDE, HIGH-FREQUENCY CIRCUIT, AND HIGH-FREQUENCY CIRCUIT DEVICE

BACKGROUND OF THE INVENTION

1. Field of the Invention

The present invention relates to a waveguide for the millimeter-wave band and the microwave band, a high-frequency circuit, and a high-frequency circuit device having the waveguide.

2. Description of the Related Art

A three-dimensional waveguide such as a hollow rectangular waveguide, which is a composite of two conductor plates, is known. For example, such a waveguide is disclosed in Japanese Unexamined Patent Application Publication No. 2002-76716 (described in paragraphs 0015 through 0017, and 0021, and shown in FIG. 1 of the cited document). The waveguide is formed by bonding two conductor plates having grooves that face each other. Additional grooves are formed at both sides of each groove to function as a choke in order to suppress electromagnetic wave leakage.

In this structure, electrical properties of the assembled waveguide are disadvantageously non-uniform due to the frequency characteristics of the chokes, which depend upon the machining accuracy of the grooves for the chokes. To obtain uniform electrical properties, high machining accuracy is required. Further, the width of the grooves for the chokes should be ¼ of the wavelength, resulting in a large waveguide. Furthermore, the disclosed document does not describe a method for bonding the two conductor plates to secure them together.

SUMMARY OF THE INVENTION

Accordingly, it is an object of the present invention to provide a structure of a waveguide composed of two conductor plates to obtain stable characteristics, an electrically improved waveguide which reliably suppresses electromagnetic wave leakage from the contact surface of the conductor plates, and a high-frequency circuit and a high-frequency circuit device having the waveguide.

According to a first aspect of the present invention, a waveguide includes two conductor plates each of which has a surface having a groove. At least one of the conductor plates has protrusions extending from the surface at both sides of the groove. The conductor plates are in contact with each other such that the grooves face each other. Fasteners are disposed outside the protrusions and fix the conductor plates together at a predetermined pressure.

According to a second aspect of the present invention, a waveguide includes a first conductor plate having a surface having a groove, and a second conductor plate. The first conductor plate has protrusions extending from the surface at both sides of the groove. The second conductor plate is in contact with the first conductor plate such that the groove faces the second conductor plate. Fasteners are disposed outside the protrusions and fix the conductor plates together at a predetermined pressure. As a result, an electrically improved waveguide having stable characteristics is provided. Additionally, electromagnetic wave leakage from the contact surface of the two conductor plates is reliably suppressed.

Preferably, in this waveguide, the protrusions taper such that the distance between the surface facing the other conductor plate and the other conductor plate increases as the protrusions extend outwardly from the edges at the opening of the groove. These tapers apply the maximum pressure to the contact surfaces at both sides of the groove, resulting in electromagnetic wave leakage being reliably blocked.

Preferably, in this waveguide, the surfaces of the protrusions facing the other conductor plate are formed by a cutting or a grinding process. This minimizes the gap between the surfaces, resulting in electromagnetic wave leakage being reliably blocked.

Preferably, in this waveguide, the smoothness of the surfaces of the protrusions facing the other conductor plate is increased as a result of the predetermined pressure. This also minimizes the gap between the surfaces, resulting in electromagnetic wave leakage being reliably blocked.

Preferably, in this waveguide, the protrusions are formed by molding; thereby the waveguide can be manufactured in a short time and at low cost.

Preferably, in this waveguide, the fasteners comprise screws, which fasten the two conductor plates by screwing at points between the protrusions and bumps, which are formed outside the protrusions and have substantially the same height as the protrusions. This structure easily bonds and secures the two conductor plates with a predetermined pressure. Since the positions of the conductor plates are determined by the positions of threaded holes, the conductor plates can be fastened in place by inserting the screws.

Preferably, in this waveguide, the protrusions are formed on only one of the two conductor plates. This simplifies the structure of the conductor plates, resulting in low manufacturing cost.

Preferably, in this waveguide, a dielectric material is inserted in the grooves to form a dielectric-loaded waveguide. As a result, a small three-dimensional waveguide that blocks electromagnetic wave leakage is provided.

Preferably, a high-frequency circuit having the waveguide is provided, wherein the waveguide functions as a signal transmission line.

Preferably, a high-frequency circuit device having the high-frequency circuit is provided, wherein the high-frequency circuit is provided in a processing section of the high-frequency circuit device for transmitting or receiving signals. Hence, a device having low transmission loss and high power efficiency is provided. Since the S/N ratio in this device is not impaired, the detection distance can be increased when the device is used in a radar. Using this device in communication devices advantageously reduces the data transmission error rate.

DESCRIPTION OF THE PREFERRED EMBODIMENTS

A hollow rectangular waveguide according to a first embodiment of the present invention will now be described with reference to FIGS. 1 to 3.

Figure 1:
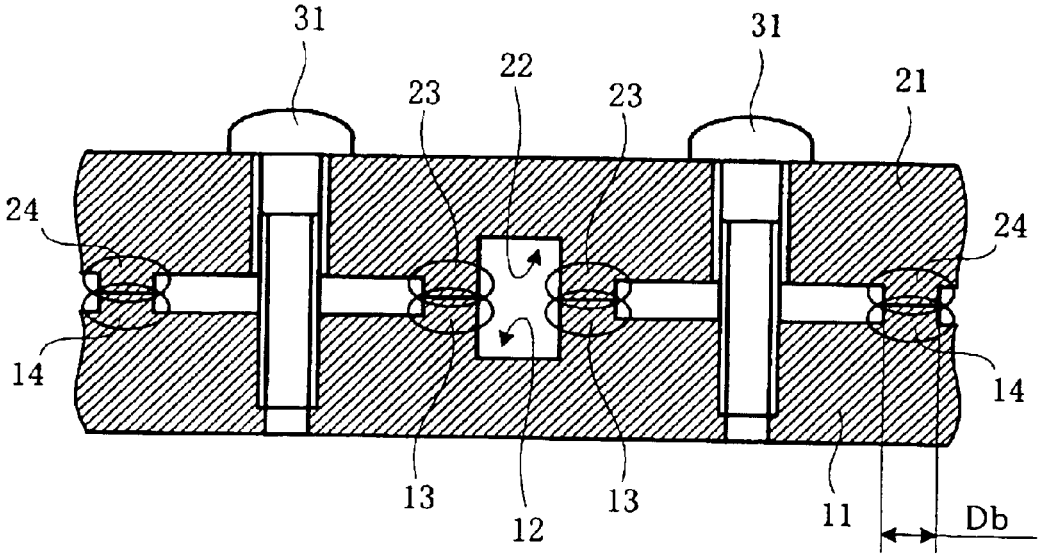
FIG. 1 is a sectional view showing the structure of a hollow rectangular waveguide according to a first embodiment of the present invention.

FIG. 1 shows a cross-sectional view of the hollow rectangular waveguide, perpendicular to signal transmission direction. In FIG. 1, the conductor plates 11 and 21 may be composed of a zinc (Zn) or aluminum (Al) metal plate. Silver (Ag) or gold (Au), which has high electrical conductivity, is preferably coated on the surfaces of the conductor plates 11 and 21. However, the coating is not required for conductor plates having high electrical conductivity, such as Al. Grooves 12 and 22, which have a substantially rectangular cross-section with a given width and a given depth, are formed on the surfaces of the conductor plates 11 and 21 that face each other. The space formed by the opposing grooves 12 and 22 functions as the hollow rectangular waveguide. The opposing surfaces of the conductor plates 11 and 21 are parallel to an E-plane, which is an upper or a lower face of the waveguide parallel to the direction of the electric field in a TE10 mode. Protrusions 13 and 23 are formed on the surfaces at both sides of the grooves 12 and 22, respectively, such that they protrude towards the other conductor plate and extend along the direction of the grooves 12 and 22. Similarly, bumps 14 and 24, which protrude towards the other conductor plate, are formed outside the protrusions 13 and 23 and extend along the direction of the grooves 12 and 22. The height of the bumps 14 and 24 is preferably substantially equal to that of the protrusions 13 and 23.

In FIG. 1, screws 31 are used as fasteners according to the present invention. Threaded holes, which are engaged with the screws 31, are formed in the conductor plate 11. As shown in FIG. 1, the conductor plates 11 and 21 are bonded and secured together with a predetermined pressure by the screws 31 engaging with the threaded holes from the exposed surface of the conductor plate 21. In this embodiment, the conductor plates 11 and 21 are bonded and secured with a predetermined pressure by the screws 31, which are disposed substantially at the center between the protrusions 13 (and 23) and the bumps 14 (and 24). The resiliency of the conductor plates 11 and 21 applies a predetermined pressure to both contact areas of the protrusions 13 and 23 and the bumps 14 and 24, thus removing any gap between the contact surfaces near the grooves 12 and 22. This reliably suppresses electromagnetic wave leakage from the contact surface of the protrusions 13 and 23.

Figure 2:
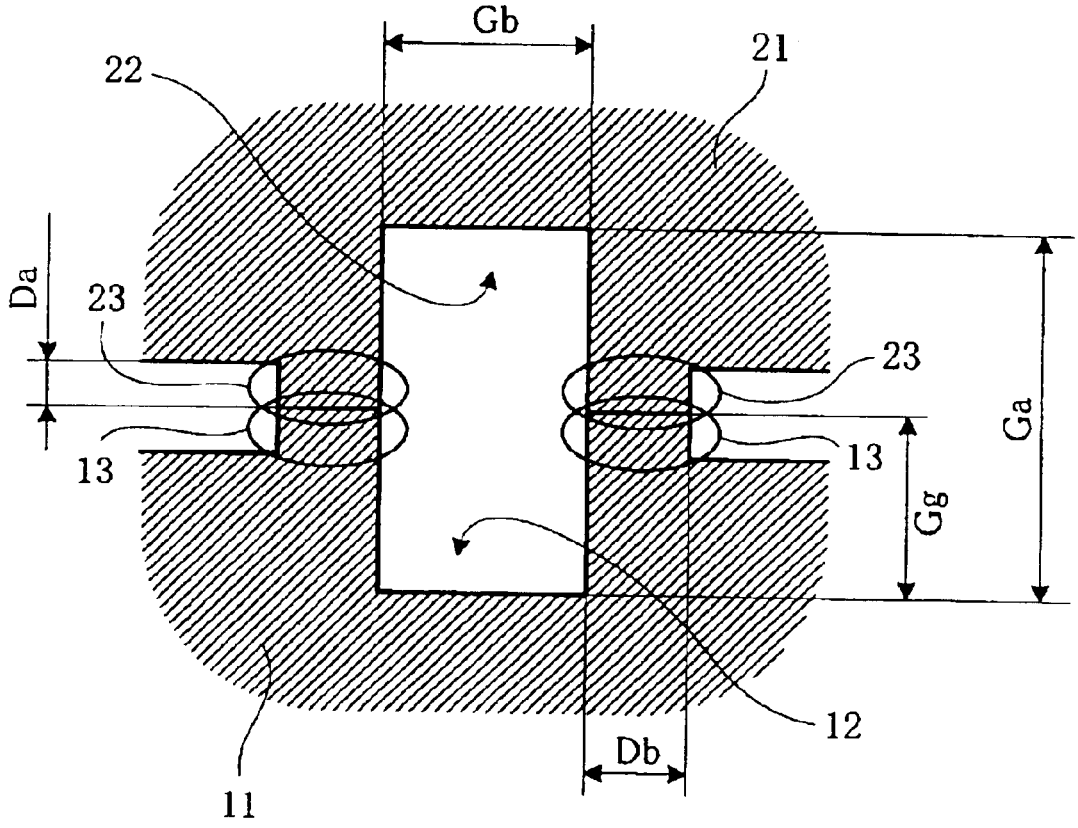
FIG. 2 is a partial sectional view of the hollow rectangular waveguide shown in FIG. 1.

FIG. 2 is a partial cross-sectional view illustrating a structure near the grooves that function as the hollow rectangular waveguide. Herein, Gg is the depth of the grooves 12 and 22. Gb is the width of the grooves 12 and 22. Ga is the height of a space formed by the opposing grooves 12 and 22. According to a design example, at a frequency of 76 GHz (W-band), Gg is 1.27 mm, Gb is 1.27 mm, and Ga is 2.54 mm.

The width Db of the protrusions 13 and 23 is preferably greater than or equal to 0.1 mm to prevent the contact area of the protrusions 13 and 23 from being too small, so that it does not require precise dimensioning and positioning of the grooves 12 and 22 and the protrusions 13 and 23 relative to the conductor plates 11 and 21 during the manufacturing process. However, the width Db of the protrusions 13 and 23 is preferably less than the width Gb of the grooves, since too large a width Db generally causes a gap between the contact surfaces at both sides of the grooves 12 and 22 due to diffuse pressure on the large contact area of the protrusions 13 and 23.

The height Da of the protrusions 13 and 23 is preferably greater than or equal to 0.05 mm in order to ensure a margin of elastic deformation outside the protrusions 13 and 23 caused by engaging of the screws 31 shown in FIG. 1. It is preferably less than about 0.4 times the depth Gg, since too large a height Da of the protrusions 13 and 23 decreases the strength of the sidewalls of the grooves 12 and 22.

Accordingly, the ranges of the height Da and the width Db of the protrusions 13 and 23 are: Da is greater than or equal to 0.05 mm and less than or equal to 0.5 mm, and Db is greater than or equal to 0.1 mm and less than or equal to 1.3 mm.

Figure 3:
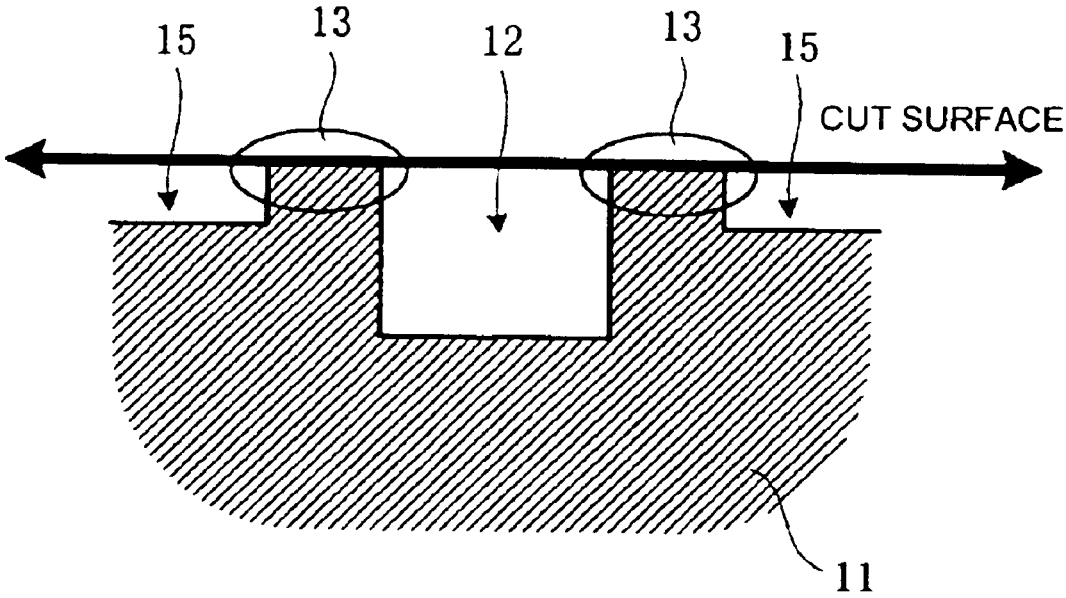
FIG. 3 is an explanatory view showing a method for processing a conductor plate of the hollow rectangular waveguide.

FIG. 3 shows a method for processing the contact surfaces of the conductor plates. The groove 12, the protrusions 13, and depressions 15 are formed on a surface of the conductor plate 11 that faces the other conductor plate 21. They are formed by a groove machining process typically used for metal plates, such as a flat aluminum plate. For example, the groove 12 and the depressions 15 are formed by cutting, such as dicing with a diamond blade or using a cutting tool. Then, as shown by the thick line with the two-headed arrow in FIG. 3, the surfaces of the protrusions 13 that contact the other protrusions 23 are cut to be a flat plane by a cutting process, for example, a grinding process. The flatness of the contact surfaces of the protrusions 13 is preferably set to be less than 0.05 mm. The other conductor plate 21 is processed in the same manner.

As shown in FIGS. 1 and 2, increasing the flatness of the contact surfaces significantly decreases the gap between the surfaces at both sides of the grooves 12 and 22 lengthwise and blocks electromagnetic wave leakage from the grooves 12 and 22 of the waveguide when they are in contact with each other with a given pressure. Since the positions of the conductor plates 11 and 21 are determined by the positions of the threaded holes, the conductor plates 11 and 21 can be fastened in place by the screws 31.

With reference to the embodiment shown in FIG. 1, inserting the screws 31 causes elastic deformation of the conductor plates 11 and 21, which reduces the space formed by two depressions between the protrusion 13 and the bump 14, and between the protrusion 23 and the bump 24. Therefore, if the depth of the depressions is determined such that the space disappears when the screws 31 are inserted with a normal torque, the pressure to the contact surface of the protrusions 13 and 23 can be constantly maintained.

In FIG. 1, a single waveguide is illustrated. To form multiple parallel waveguides by mating the upper and lower conductor plates 11 and 21, the above-described space formed by the depressions is formed between grooves of one waveguide and the adjacent waveguides, and then the conductor plates are mated and fastened together by screws at the space. That is, the bumps 14 and 24 in FIG. 1 are regarded as protrusions of the adjacent waveguides.

Moreover, to improve the accuracy of the positioning of the conductor plates 11 and 21, one of the conductor plates may have a pin and the other conductor plate may have a hole, and the positions may be determined by engagement of the pin and the hole.

Figure 4:
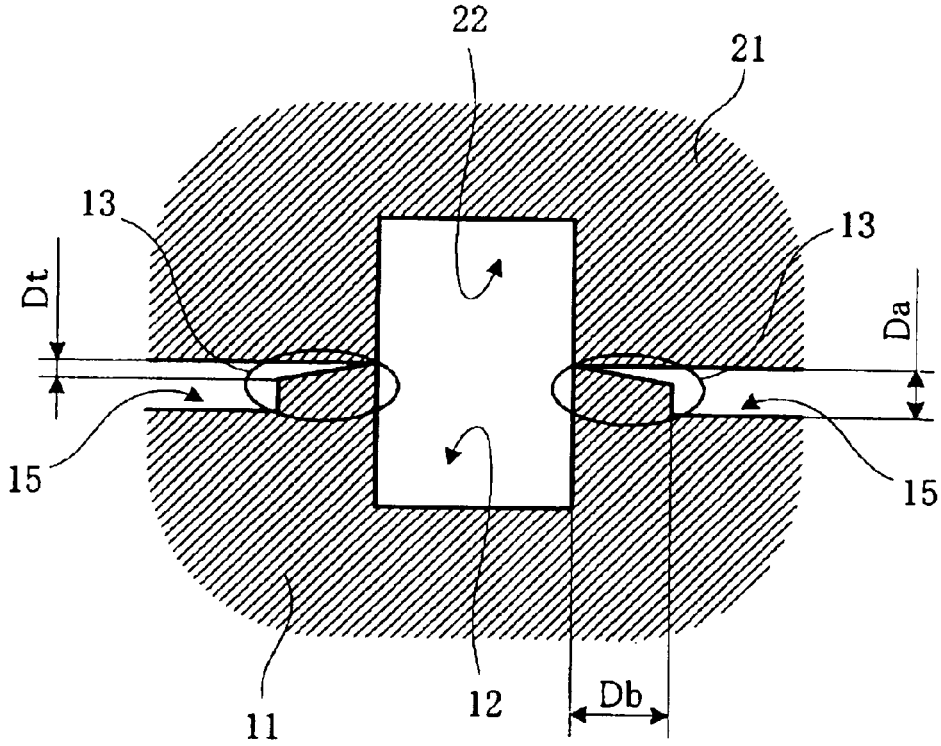
FIG. 4 is a partial sectional view showing the structure of a hollow rectangular waveguide according to a second embodiment of the present invention.

With reference to FIG. 4, a hollow rectangular waveguide according to a second embodiment of the present invention will now be described. FIG. 4 shows a partial sectional view of the hollow rectangular waveguide, which is perpendicular to a propagation direction of the electromagnetic waves. Unlike the first embodiment shown in FIG. 2, in FIG. 4 only the conductor plate 11 has the protrusions 13, while the other conductor plate 21 does not have a protrusion. The protrusions 13 taper such that the distance between the surface facing the conductor plate 21 increases as the protrusions 13 extend outwardly from the edges at the opening of the groove 12. The other elements of this structure are similar to those in FIG. 1 illustrating the first embodiment.

In this structure, the maximum pressure is applied to the surfaces at both sides of the groove 22 formed in the conductor plate 21 and the surfaces at both sides of the groove 12 formed in the conductor plate 11. Accordingly, the gap between the contact surfaces at both sides of the grooves is removed so that electromagnetic wave leakage from the waveguide is reliably blocked. Herein, Da is the height of the protrusion 13, Db is the width of the protrusion 13, and Dt is the height of the taper portion.

According to a design example, at a frequency of 76 GHz (W-band), Da is greater than or equal to 0.05 mm, Db is greater than or equal to 0.1 mm, and Dt is greater than or equal to 0.05 mm. The other measurement of the grooves 12 and 22 are preferably equal to those in the example of the first embodiment. Of course, Dt, which is the height of the taper portion, should be less than Da, which is the height of the protrusion 13. The protrusion having a taper, the groove 12, and the depressions 15 are preferably formed by molding in one operation.

Figure 5:
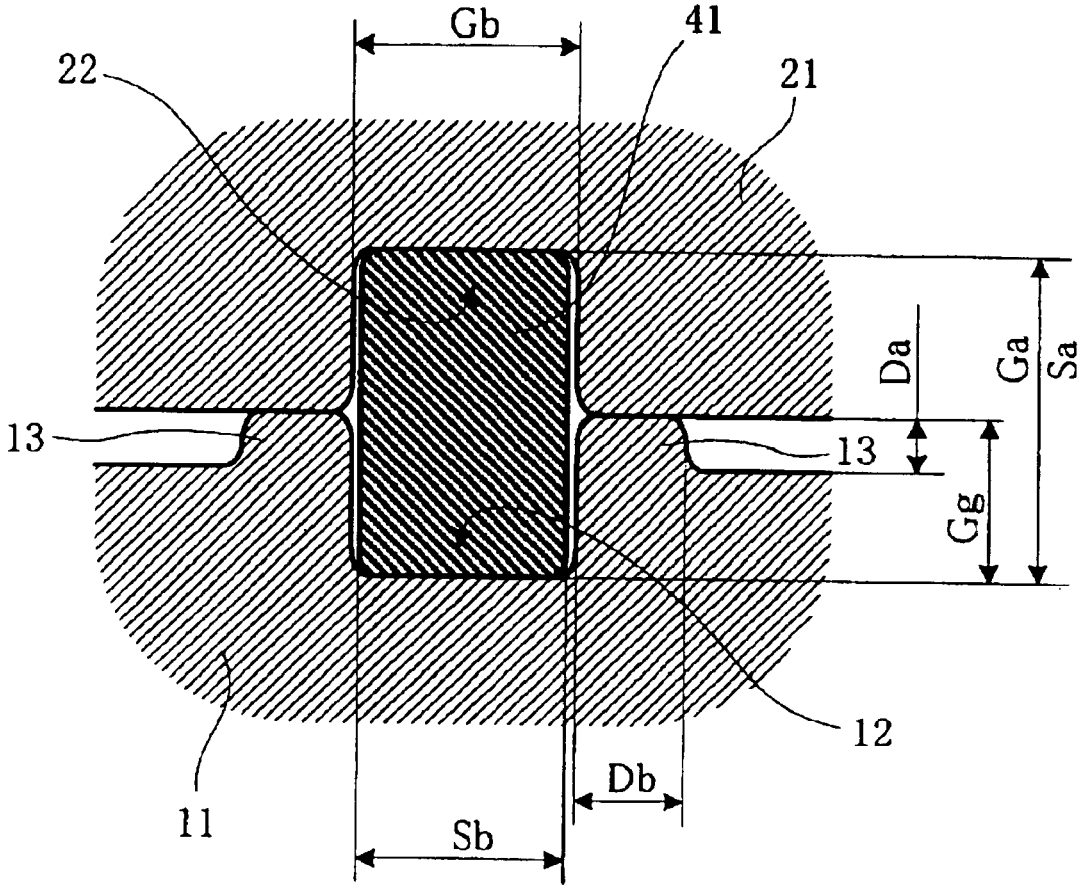
FIG. 5 is a partial sectional view showing the structure of a dielectric-loaded waveguide according to a third embodiment of the present invention.

FIG. 5 shows the structure of a dielectric-loaded waveguide according to a third embodiment of the present invention. As shown in FIG. 5, the groove 12 and the protrusions 13 are formed on the surface of the conductor plate 11 that faces the other conductor plate 21. The groove 22 is formed on the surface of the conductor plate 21 that faces the other conductor plate 11. A dielectric strip 41 is disposed in the space formed by mating the grooves 12 and 22 in the conductor plates 11 and 21, respectively. The conductor plates 11 and 21 face each other such that the grooves 12 and 22 mate. They are then fastened together with a given pressure. The other elements of this structure are similar to those in FIG. 1.

Thus, the dielectric-loaded waveguide is formed by inserting the dielectric strip 41 into the space of the waveguide having a rectangular cross-section. Herein, Gg is the depth of the grooves 12 and 22, Gb is the width of the grooves 12 and 22, Ga is the height of the space formed by mating the grooves 12 and 22, Sb is the width of the dielectric strip 41, and Sa is the height of the dielectric strip 41. According to a design example, at a frequency of 76 GHz, using a fluorocarbon resin as the dielectric strip 41, which has a relative permittivity $\epsilon r$ of about 2.0, Gg is 0.9 mm, Gb is 1.2 mm, Ga is 1.8 mm, Sa is 1.8 mm, and Sb is 1.1 mm.

With reference to FIG. 5, the wavelength $\lambda$ in the dielectric strip 41 is 2.8 mm for the selected example frequency. The width Gb is less than or equal to a half of $\lambda$. The height Ga of the space is greater than or equal to a half of $\lambda$ and less than or equal to $\lambda$.

This structure allows for transmission in a single mode at the selected frequency band. Since the transmission is performed in only the rectangular TE10 mode and all other modes are blocked, mode switching does not occur even if the position of the groove in the conductor plate is shifted. As a result, transmission loss is reduced since there is no loss caused by mode switching.

In this embodiment, the edges at the openings of the grooves 12 and 22 are formed to be rounded with a given radius of curvature. Further, the outer edges of the protrusions 13 are rounded. Furthermore, the bottom edges of the grooves 12 and 22 are rounded. This shape allows the conductor plates 11 and 21 to be easily formed by molding (die casting), resulting in low manufacturing cost.

The surface roughness of the protrusions 13 that face the conductor plate 21 is determined such that the pressure by the conductor plate 21 increases the smoothness of the surface. This reduces gaps between the surfaces at both sides of the grooves 12 and 22 when the conductor plates 11 and 21 are in contact with each other. As a result, electromagnetic wave leakage is reliably blocked.

The space between the sidewalls of the grooves 12 and 22 and the dielectric strip 41 absorbs any distortion caused by a difference in the coefficients of liner expansion between the conductor plates 11 and 21 and the dielectric strip 41. More specifically, thermal expansion of the dielectric strip 41 relative to the grooves 12 and 22 is absorbed by the space so that the dielectric strip 41 does not receive stress concentration from the conductor plates 11 and 21. This suppresses any fluctuation in the electrical characteristics.

The conductor plates 11 and 21 may be formed by forging instead of die casting. Alternatively, the conductor plate body may be formed by molded resin with metal coated thereon.

The dielectric strip 41 used in the above-described frequency band is not limited to a fluorocarbon resin. It may be a dielectric material having another relative permittivity. The depth Gg and the width Gb of the groove may be adjusted according to the relative permittivity. In the above-described embodiments, the grooves in the two conductor plates are mated to form the waveguide. However, the present invention is not limited thereto. That is, the present invention can be applied to a waveguide in which a groove is formed in only one conductor plate, which is mated with another, flat conductor plate.

Figure 6:
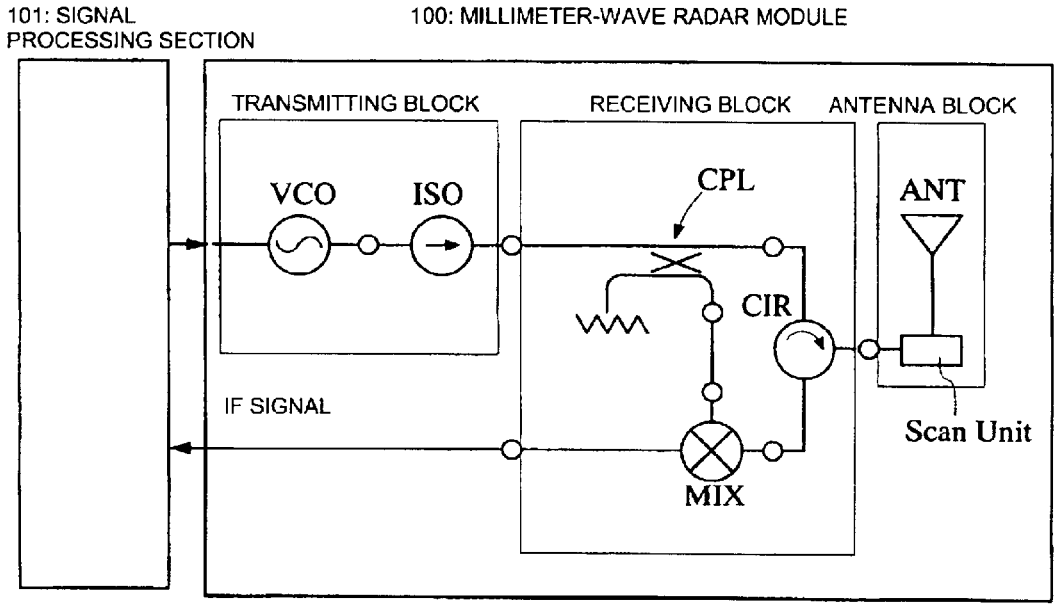
FIG. 6 is a block diagram showing the structure of a millimeter-wave radar module and a millimeter-wave radar according to a fourth embodiment of the present invention.

With reference to FIG. 6, a millimeter-wave radar module and a millimeter-wave radar will now be described, which are embodiments of a high-frequency circuit and a high-frequency circuit device, respectively, according to a fourth embodiment of the present invention.

In FIG. 6, VCO is a voltage-controlled oscillator using a Gunn diode and a varactor diode, ISO is an isolator which prevents a reflected signal from returning to the VCO, and CPL is a coupler which retrieves a part of the transmission signal as a local signal. CIR is a circulator which supplies the transmission signal to a primary radiator of antenna ANT and transmits a reception signal to a mixer MIX. The mixer MIX generates a high-frequency wave from the reception signal and the local signal to output it as an intermediate frequency (IF) signal.

The above-described section is the millimeter-wave radar module 100. A signal processing section 101 detects the relative distance to and the relative speed of a target from a modulating signal transmitted to the VCO of the millimeter-wave radar module 100 and the IF signal received from the millimeter-wave radar module 100. The millimeter-wave radar is composed of the signal processing section 101 and the millimeter-wave radar module 100.

A device which has a low transmission loss and high power efficiency is provided by using one of the above-described waveguides as a transmission line of such a millimeter-wave radar module and millimeter-wave radar. Since the S/N ratio of this waveguide is not impaired, the detection distance can be increased. In addition, using this transmission line in communication devices provides an advantage of a low data transmission error rate.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A waveguide comprising:

two conductor plates, each conductor plate having a face having a groove therein, at least one of the conductor plates having protrusions extending outward from the face along opposing sides of the groove, the conductor plates being in contact with each other such that the grooves in each of the two conductor plates face each other; and fasteners disposed distal from the grooves and the protrusions, the fasteners fixing the conductor plates with a predetermined pressure.

2. The waveguide according to claim 1, wherein a surface of the protrusions which contacts the other of the two conductor plates is tapered such that a distance between the surface of the protrusions and the other conductor plate increases as the protrusions extend outwardly from the groove.

3. The waveguide according to claim 1, wherein a surface of the protrusions facing the other of the two conductor plates is formed by a cutting or a grinding process.

4. The waveguide according to claim 1, wherein a smoothness of a surface of the protrusions facing the other of the two conductor plates is increased as a result of the predetermined pressure.

5. The waveguide according to claim 1, wherein the protrusions are formed by molding.

6. The waveguide according to claim 1, further comprising bumps extending outward from the face of at least one of the two conductor plates, the bumps being disposed distal from the grooves relative to the fasteners.

7. The waveguide according to claim 6, wherein the fasteners comprise screws which fasten the two conductor plates at points between the protrusions and the bumps.

8. The waveguide according to claim 6, wherein the bumps have substantially the same height as the protrusions.

9. The waveguide according to claim 1, wherein the protrusions are formed on both of the two conductor plates, the protrusions of each conductor plate contacting each other when the two conductor plates are in contact with each other.

10. The waveguide according to claim 1, wherein a dielectric material is disposed in the grooves.

11. A high-frequency circuit having the waveguide according to claim 1, wherein the waveguide functions as a signal transmission line.

12. A high-frequency circuit device having the high-frequency circuit according to claim 11, wherein the high-frequency circuit is provided in a processing section of the high-frequency circuit device for transmitting or receiving signals.

13. A waveguide comprising:

a first conductor plate having a face having a groove, the conductor plate having protrusions extending outward from the face along opposing sides of the groove;

a second conductor plate having a face and a groove, the second conductor plate being in contact with the first conductor plate such that the groove of the first conductor plate faces the groove of the second conductor plate; and fasteners disposed distal from the grooves and the protrusions, the fasteners fixing the conductor plates with a predetermined pressure.

14. The waveguide according to claim 13, wherein a surface of the protrusions which contact the second conductor plate is tapered such that a distance between the surface of the protrusions and the second conductor plate increases as the protrusions extend outwardly from the groove.

15. The waveguide according to claim 13, wherein a smoothness of a surface of the protrusions facing the second conductor plate is increased as a result of the predetermined pressure.

16. The waveguide according to claim 13, further comprising bumps extending outward from the face of one of the first and second conductor plates, the bumps being disposed distal from the grooves relative to the fasteners.

17. The waveguide according to claim 16, wherein the fasteners comprise screws which fasten the first and second conductor plates at points between the protrusions and the bumps.

18. The waveguide according to claim 16, wherein the bumps have substantially the same height as the protrusions.

19. The waveguide according to claim 13, wherein a dielectric material is disposed in the grooves.

20. A high-frequency circuit device comprising:

a high-frequency circuit having the waveguide according to claim 13, wherein the high-frequency circuit is provided in a processing section of the high-frequency circuit device for transmitting or receiving signals.

* * * * *